US005933893A

United States Patent [19]

Padden

[11] Patent Number: 5,933,893

[45] Date of Patent: Aug. 10, 1999

[54] MULTI-PURPOSE TOOL WITH SLIDING LOCK PLATE

[76] Inventor: Stephen J. Padden, 1303 Cypress Point La., Apt. 204, Ventura, Calif. 93003

[21] Appl. No.: 09/006,282

[22] Filed: Jan. 13, 1998

[51] Int. Cl.[6] ..... B26B 11/00; B26B 3/06

[52] U.S. Cl. ..... 7/158; 7/118; 30/123; 30/159; 30/160

[58] Field of Search ..... 7/118, 158; 30/160, 30/161, 331, 123, 131, 159, 158; D8/105

[56] References Cited

U.S. PATENT DOCUMENTS

| | | | |
|---|---|---|---|
| D. 101,073 | 9/1936 | Tamis . | |
| D. 172,108 | 5/1954 | Polincovsky . | |
| D. 288,898 | 3/1987 | Osterhout . | |
| 297,375 | 4/1884 | Freund | 86/22 |
| D. 374,388 | 10/1996 | Padden . | |
| 464,405 | 12/1891 | Widmann . | |
| 592,612 | 10/1897 | Johnson | 30/159 |
| 973,930 | 10/1910 | Fink . | |
| 1,590,492 | 6/1926 | Benson . | |
| 1,828,121 | 10/1931 | Adam et al. | 132/75.5 |
| 2,408,888 | 10/1946 | Shoop . | |
| 2,412,056 | 12/1946 | Mosch . | |
| 2,530,236 | 11/1950 | Erickson | 30/159 |
| 2,630,212 | 3/1953 | Mosch . | |
| 2,808,646 | 10/1957 | Lohr, Jr. et al. | 30/159 |
| 3,832,775 | 9/1974 | Stahel, II et al. | 30/152 |
| 5,328,026 | 7/1994 | Newman . | |
| 5,402,575 | 4/1995 | Maxcy | 30/123 |

*Primary Examiner*—David A. Scherbel
*Assistant Examiner*—Philip J. Hoffmann
*Attorney, Agent, or Firm*—Kenneth J. Hovet

[57] ABSTRACT

A multi-purpose tool housing is provided having an implement that is rotatably stowable in an individual housing opening. The opening includes a separate lock plate that engages the end surfaces of a pivot plate that extends from an inner end portion of the implement. The end surfaces are angularly oriented to permit the lock plate to not only secure the implement in a storage mode, but also secure the implement in predetermined angular orientations for convenience of use. A spring biased plunger, flexible bands and spring members operate between the housing and implement to automatically move a portion of the implement out of the housing opening to a predetermined access orientation. Thereafter, a user may readily grasp the implement and rotate it to the desired use position. When scissors are being used with a flex strip between the scissors handles, a bumper part coacts with the lock plate to hold the handles together for storage against the flexural bias of the flex strip. Upon release, the flex strip will automatically push at least one of the scissors handles out of the opening to the aforementioned access orientation.

20 Claims, 5 Drawing Sheets

MULTI-PURPOSE TOOL WITH SLIDING LOCK PLATE

BACKGROUND OF THE INVENTION

1. Field of the Invention

The invention is related to compact multi-purpose tools and, more particularly, to a multi-purpose tool housing that includes implement lock and release means.

2. Description of Related Art

The present invention evolved from multi-function pocket knives which utilize wide casings to contain a variety implements such as knife blades, awls, corkscrews, tools and even scissors. Recent innovations have been made by the inventor for incorporating multiple implements in thin housings including a reciprocable brush, golf tools and a miniature light. These developments are disclosed in the inventor's pending application Ser. No. 08/963,167 filed Nov. 3, 1997 and Ser. No. 08/979,136 filed Nov. 26, 1997 which are hereby incorporated by reference.

Unfortunately, the quality of compact implements and related accessories stored within a small housing is frequently poor. This is most often the result of size and space limitations. In some instances, it is also because the addition of diverse tools or personal accessory items are more of a marketing strategy than a bona fide attempt to add a useful implement.

Moreover, it is cumbersome and difficult to use a small implement, such as scissors, when appended to a ponderous multi-function housing. In fact, for many people, both hands are required to operate the scissors. One hand is used to hold the housing and the other hand is used to operate the scissors.

Further, very little thought has been given to how the various implements may be withdrawn from a housing such as a pocket knife casing. Most typically, a user needs to have strong fingernails, a coin, screwdriver or some other means for engaging an exposed portion of the implement and prying it out of the casing. Once out, the implement can be used in only one position—straight out in alignment with the knife casing.

SUMMARY OF THE INVENTION

The present invention overcomes the aforementioned disadvantages by providing a unique housing/elongated implement combination that utilizes an elongated edge opening in the housing periphery to separately and individually enclose the implement. The opening includes an engagement means to releasably secure the implement in a locked position within the housing. The engagement means also has an unlocked release mode where the implement will be free to rotate to convenient orientations chosen by the user. To eliminate problems in withdrawing the implement from the housing, a biasing means is provided to move at least a portion of the implement out of the housing whereby it can then be easily accessed for further positioning.

A particularly unique aspect of the invention is that inherent characteristics and structures of a scissors can be used to effect the aforementioned actions. One handle of the scissors may be used to form an abutment means that interacts with the engagement means to effect the aforementioned releasable securement in selected angular orientations. Additionally, the flexible strip that is oftentimes used to separate scissors handles may function as the biasing means. Also, the housing may become an extension of the scissor handle thereby facilitating use of the scissors. Still further, the overall assembly can all be incorporated within a narrow opening of a thin lightweight housing.

DESCRIPTION OF THE PREFERRED EMBODIMENTS

Figure 1:
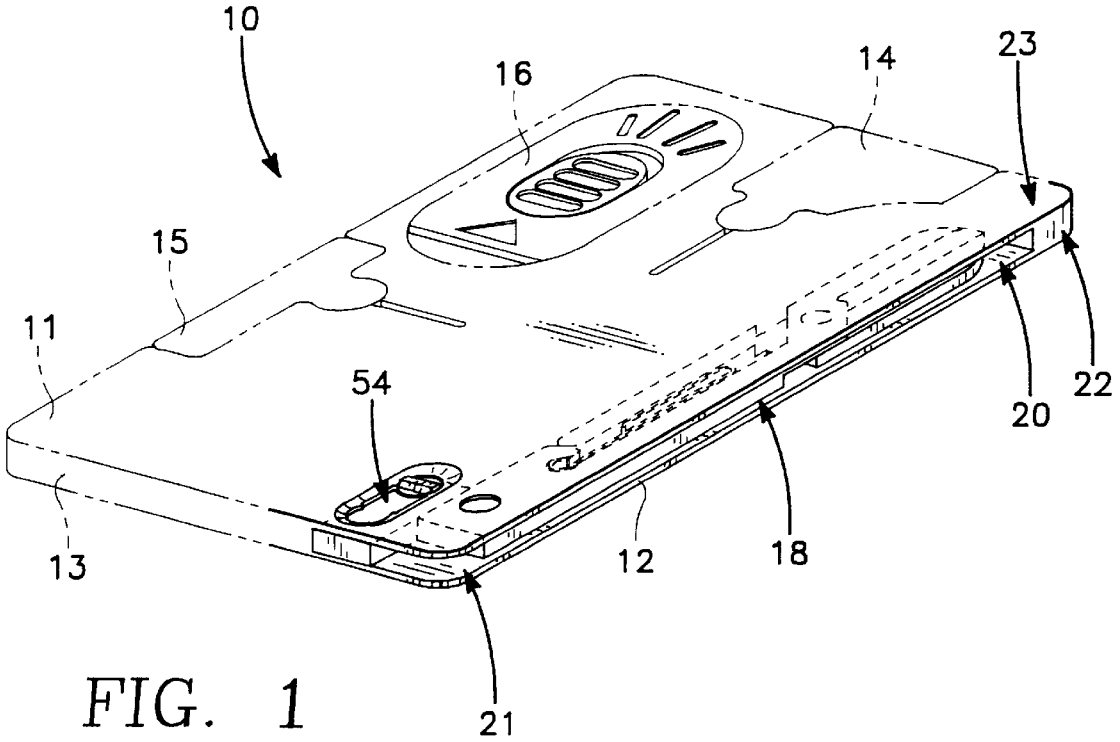
FIG. 1 is a top isometric view of a multi-purpose tool comprising a tool housing that contains scissors in accordance with the present invention.

With reference now to FIG. 1 of the drawings, the overall multi-purpose housing of the invention is shown by reference 10. The housing is defined by opposing generally flat planar sidewalls comprising top wall 11 and bottom wall 12. The walls enclose a generally hollow interior and are secured together by interior mechanical fasteners, adhesives or other bonding means known in the art. The walls have respective marginal edge portions 23,24 which come together and form outwardly facing flat peripheral edges 13. The peripheral edges are provided with predetermined spaces for the insertion of selected implements.

To enclose and accommodate the thickness of the implements, the sidewalls are spaced-apart a predetermined distance. For exemplary purposes only, the phantom lines of FIG. 1 illustrate the handles of a knife 14 and a bottle/can opener 15. Also shown in phantom is a miniature light 16, described in the inventor's pending application Ser. No. 08/963,167, and a scissors 18 which will be described in detail below.

Although a flat rectangular shaped housing is shown, other shapes and sizes could be used. However, since most implements, including scissors, are usually elongated and somewhat straight, it is preferable to have at least one sidewall that is generally planar in shape with a length that exceeds the overall implement length.

Figure 2:
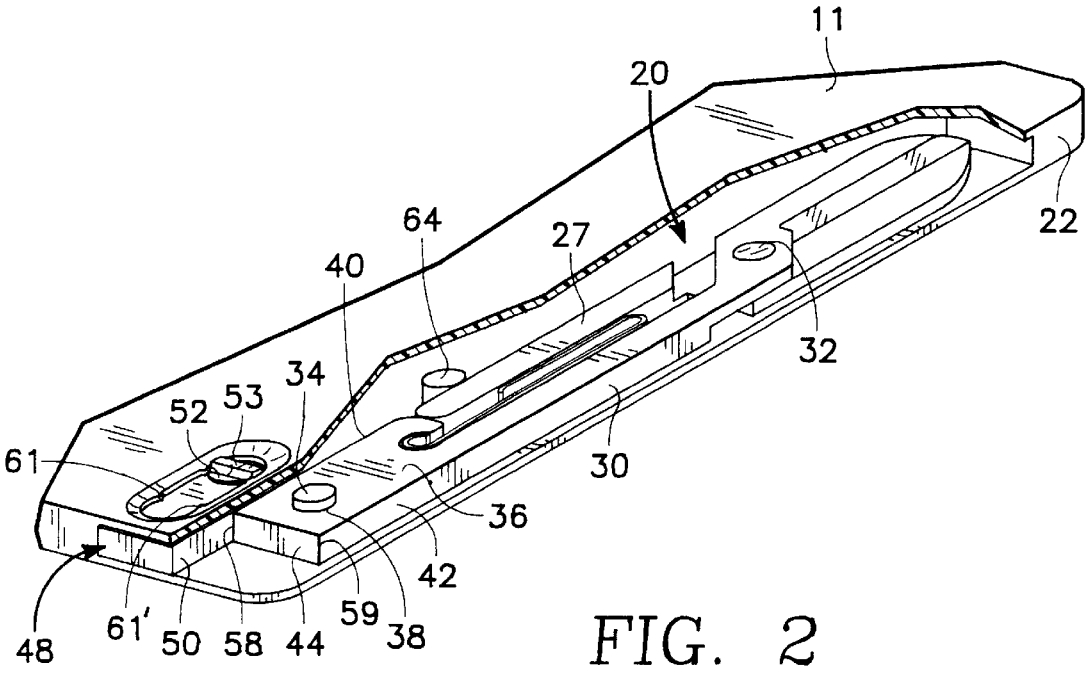
FIG. 2 is an enlarged fragmentary isometric view showing the housing partially broken-away and the scissors of FIG. 1 in a locked position.

To maximize the usefulness of scissors 18, an implement opening 20 is preferably located along the longest peripheral edge of the housing. The opening is defined by the space between the marginal edge portions 23,24 of the sidewalls and extends along a longitudinal section of the periphery from a housing open corner 21 to a housing closed corner 22. For aesthetics and safety purposes, it is preferred that the depth of the opening be sufficient to entirely enclose the width of the scissors when in a closed stowed orientation as depicted in FIGS. 1 and 2.

The scissors 18 comprises an actuation arm 25 and an attachment arm 28. In a conventional manner, the arms cross-over each other proximate their respective mid-regions and are rotatably connected at the cross-over point with swivel pin 32. The free end portion of each arm that extends outwardly from the swivel pin comprises respective scissor blades 26,29.

The inwardly directed end portion of the actuating arm comprises actuating handle 27. Both ends of the actuating arm freely rotate about the swivel pin.

The end portion of attachment arm 28 extending inwardly from swivel pin 32, comprises pivot handle 30. The pivot handle is rotatably connected to the housing by a connector means shown as implement post 34. The implement post extends upwardly from bottom wall 12 into the interior space of open corner 21. It is located inwardly from the housing periphery to facilitate its use as the rotational axis for the scissors.

The terminal end of the pivot handle is provided with an abutment means comprising an enlarged axially extending extension structure shown as pivot plate 36. The pivot plate is preferably flat and defines a plane that is coextensive with the attachment arm. It extends into open corner 21 and includes a pivot opening 38 into which the implement post 34 extends.

The outer end surfaces of the pivot plate are preferably flat and define a plane that is parallel to the center axis of the implement post 34. They are aligned relative to the longitudinal axis of the pivot handle to provide predetermined angular orientations of the scissors in a manner to be described below.

The pivot plate is shown as having three outer end surfaces comprising an inner lock surface 40, an opposing outer surface 42 and a cross surface 44. The lock surface and outer surface are parallel to each other and are parallel to the longitudinal axis of the scissors. The cross surface comprises the back end of the pivot plate and extends perpendicular to the lock and outer surfaces.

It will be appreciated that more than three end surfaces could be provided. The total will be determined by the number of preset angular orientations one wishes to have for the scissors. Preferably, the total sum of the angles should not exceed 180°.

Also located in open corner 21 is an engagement means for releasably securing the scissors in the above described orientations. The engagement means comprises a lock plate 48 that reciprocates within the corner space between sidewalls 11,12 directly adjacent pivot plate 36. The lock plate is preferably polygonal in shape and includes an abutment surface 50 comprising a flat side edge that forms a plane that is parallel to the end surfaces.

Extending upwardly from an end section of the plate upper surface is a knob 52. The knob projects into a wall opening 54 and includes a rib 53 to permit manual actuation of the plate. The knob has a sufficient diameter to closely fit between the inner sides of the wall opening. In this way, the wall opening will define the direction and reciprocation span of the lock plate. As shown, the wall opening has an oblong shape with a longitudinal axis that is parallel to abutment surface 50.

Figure 4:
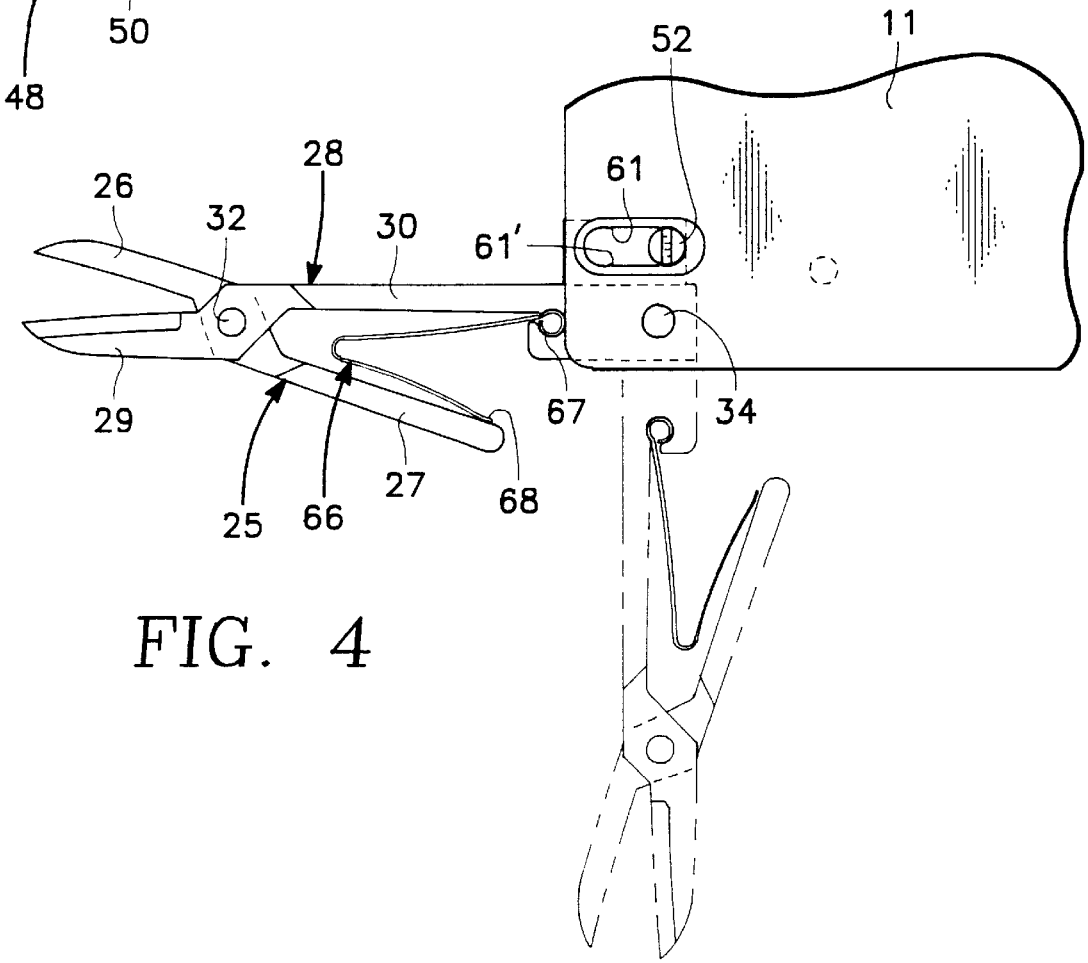
FIG. 4 is a top plan fragmentary view of a corner of the housing shown in FIG. 1 illustrating different angular orientations of the scissors.
Figure 8:
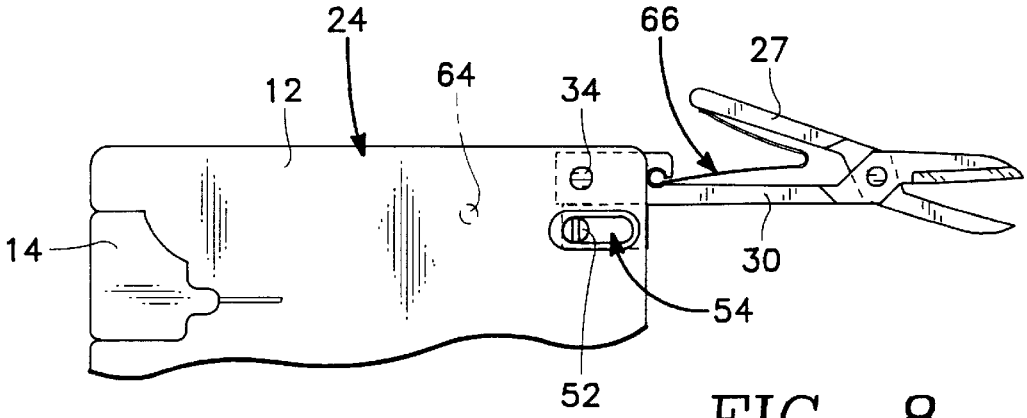
FIG. 8 is a reduced scale fragmentary bottom plan view of the housing shown in FIG. 1 with the scissors extending longitudinally.
Figure 9:
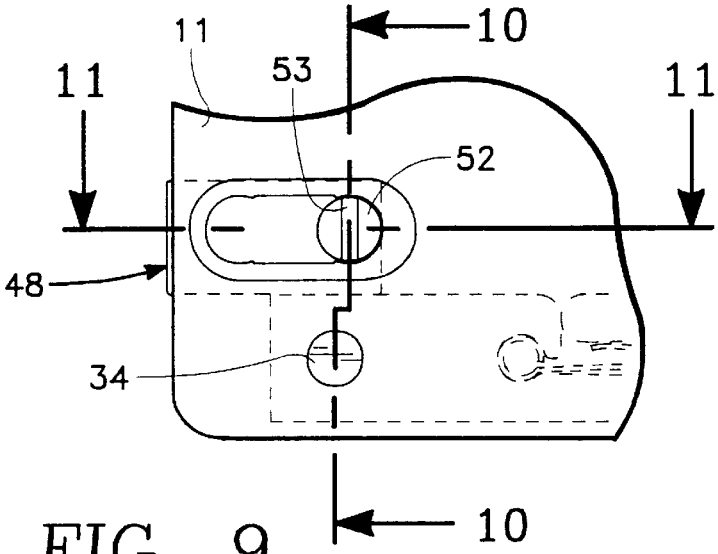
FIG. 9 is an enlarged fragmentary top plan view of a corner of the housing shown in FIG. 1.
Figure 10:
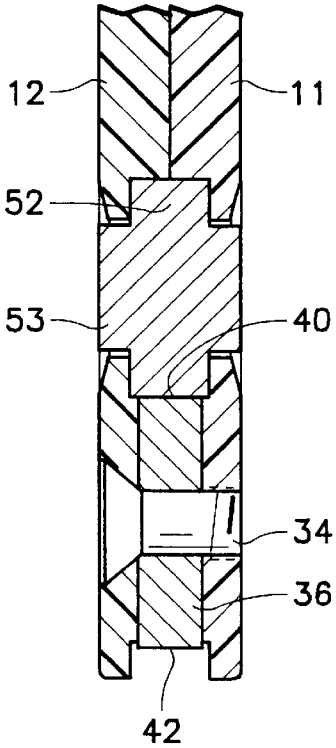
FIG. 10 is a cross-sectional view taken along lines 10—10 of FIG. 9.
Figure 11:
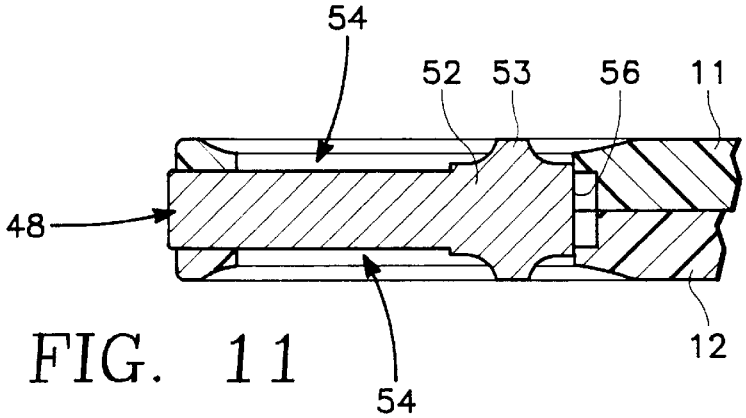
FIG. 11 is a cross-sectional view taken along lines 11—11 of FIG. 9.

To create the desired contact for each one of the pivot plate end surfaces, the axis of pivot opening 38 is located equidistant from each of the lock, outer and cross surfaces. Also, the lock plate and pivot plate each have sufficient width to come into mating contact with each other when knob 52 is positioned at the rearward end of wall opening 54. With the above alignments and engagements, the scissors can be releasably secured in a stowed orientation as shown in FIG. 2 or be aligned 180° in the opposite direction as shown in FIGS. 4 and 8. When abutment surface 50 engages cross surface 44, the scissors will be aligned 90° from the abutment surface and be perpendicular to the longitudinal axis of the implement opening 20.

To release the scissors for rotational movement, knob 52 is moved to the forward end of the wall opening. This action moves back edge 56 of the lock plate outside the maximum arc defined by the opposing edge corners 58,59 of pivot plate 36 when the plate rotates about implement post 34. When the scissors is in the desired preset angular orientation, the knob is pushed rearward to move the plate back to its locked position. In this position, the abutment surface 50 will engage the end surface that corresponds to the selected angular orientation.

To help retain the lock plate in the locked and unlocked positions, the inner sides of wall opening 54 are provided with retention means. As shown, this comprises an opposing pair of forward friction projections 61,61' and an opposing pair of rearward friction projections 62,62'.

Figure 3:
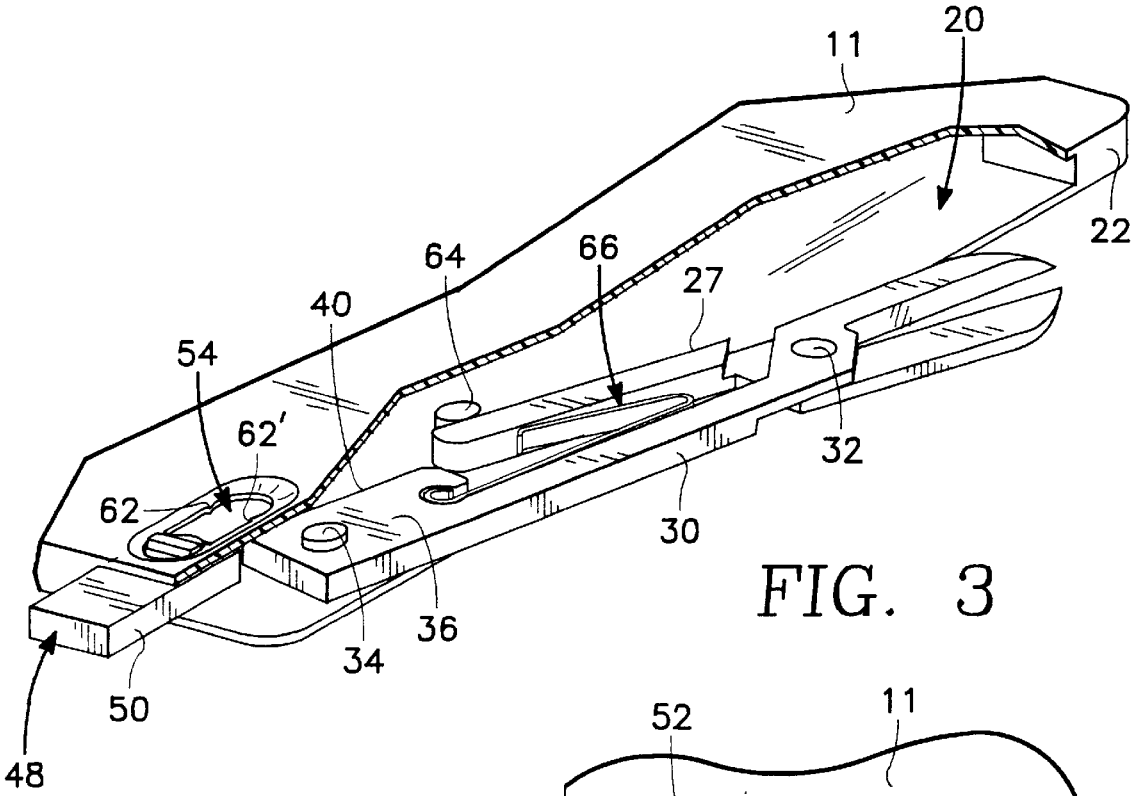
FIG. 3 is a view similar to FIG. 2 showing the scissors in an unlocked position.
Figure 7:
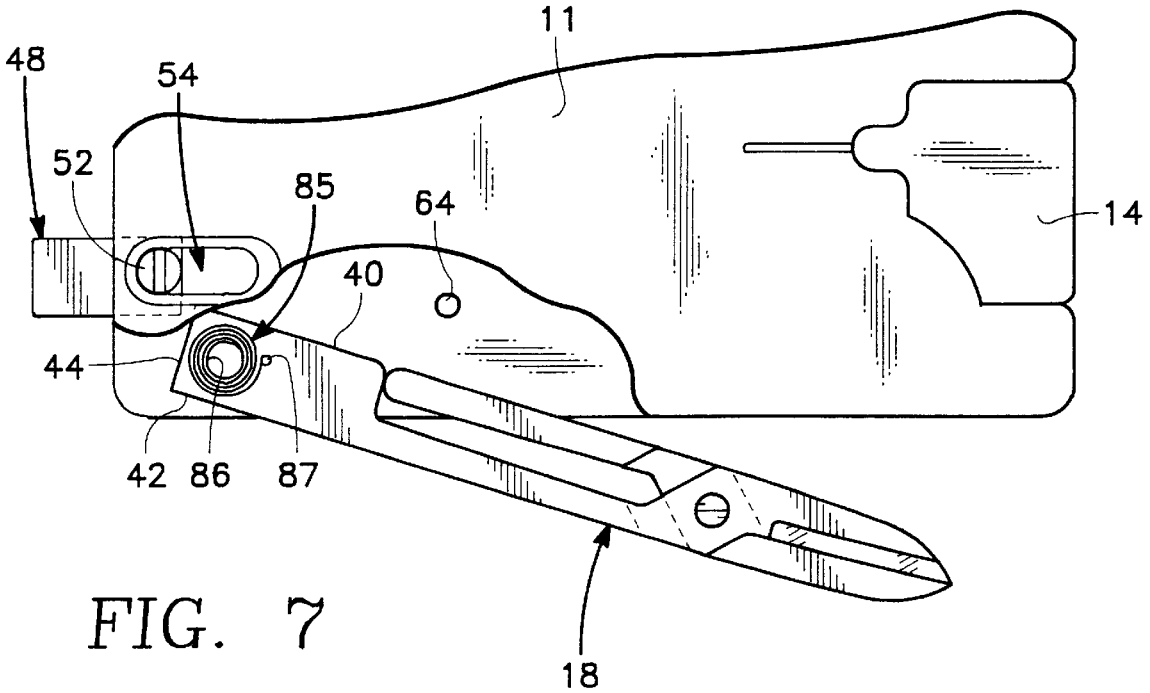
FIG. 7 is a view similar to FIG. 5 showing the scissors moved out of the housing with a torsion spring.

The interior of implement opening 20 includes a bumper part 64. The peripheral edge offset location of this part determines the depth of the implement opening. As depicted in FIGS. 2, 3 and 7, the bumper part is spaced inward along an imaginary line about coextensive with abutment surface 50. It is longitudinally offset from the implement post a distance that proximates the axial location of the inner free end portion of actuating handle 27.

The bumper part provides auxiliary support for maintaining the scissors in a stowed orientation. It also functions to deflect the actuating handle 27 to a closed position adjacent pivot handle 30 when the scissors is stowed. This function is particularly important when a spring member is interposed between the actuating and pivot handles.

As best illustrated in FIGS. 2–4, the spring member comprises a V-shaped flex strip 66 that is anchored to an inner notch 67 of the pivot plate. The strip free end 68 rides against the inner face of actuating handle 27 as the handles are brought together during scissoring action.

The above flex strip also functions as a biasing means to move at least a portion of the scissors from a stowed orientation to a pre-use access orientation out of the implement opening. This movement occurs because the flex strip creates an outward bias when the scissors handles are brought together for storage in the implement opening. Upon release, the flex strip will spring back to its unstressed state and simultaneously cause the scissors to rotate partially out of the implement opening. It is then an easy matter to grasp the scissors and move it to a selected use position as dictated by the angulation of the pivot plate end surfaces. Thereafter, the lock plate may be moved back to a locked position. Alternatively, one may simply leave the plate in an unlocked position and work with the scissors without a rigid angular connection to the housing.

Other spring member biasing means, such as a compression spring, torsion spring and resilient band could by used to effect the above action. It will also be appreciated that the above alternative biasing means would have relevance to arrangements whereby other types of elongated implements or accessory items are used in place of the scissors. Examples of such items are blades, files, scribes, awls, golf divot tools, pens, pliers, screwdrivers, can openers, bottle openers, rulers, thermometers, tweezers, toothpicks, brushes, watches and saw blades.

Figure 5:
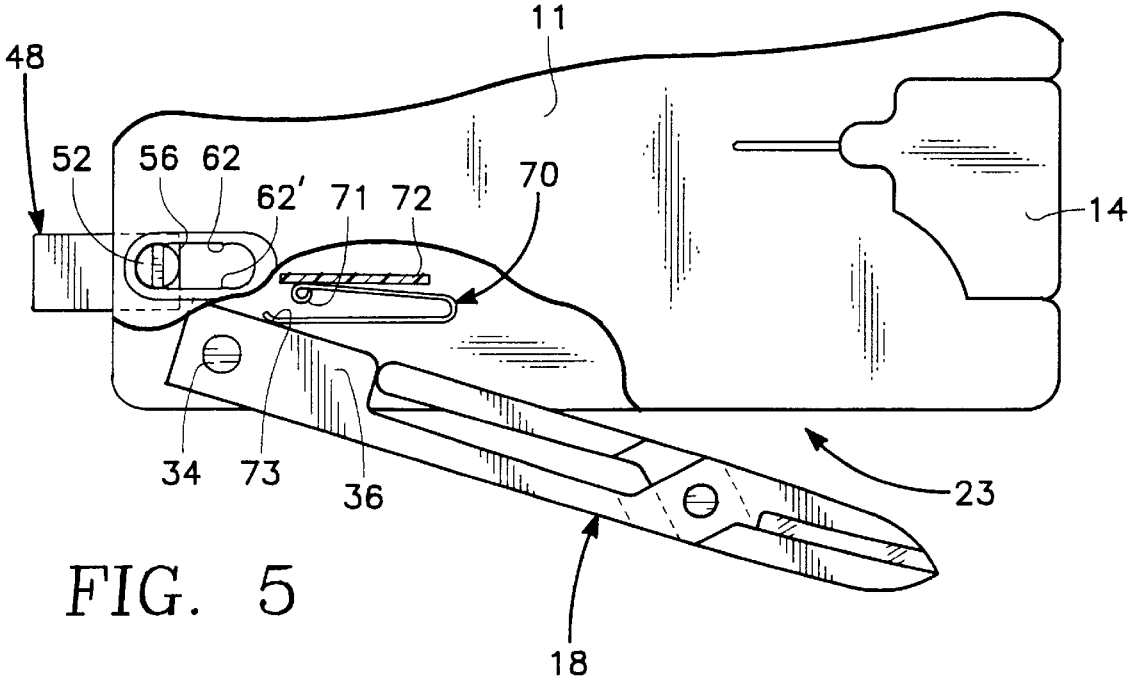
FIG. 5 is a top plan fragmentary view of the housing of FIG. 1 partially broken-away illustrating the scissors moved out of the housing with a bent resilient strip.

FIG. 5 illustrates a bent resilient band 70 having a first end 71 attached to a partition 72. The partition extends upwardly from bottom wall 12 and is parallel to abutment surface 50. It is longitudinally offset from the implement post 34 so that it can support the band when the band is pushed against itself. The band has sufficient length to engage the actuating handle when the scissors is being moved into a stowed position. As such, the bumper part may be omitted. The band free end 73 rides against a portion of lock surface 40 and causes flexure of the band during movements of the scissors in and out of the implement opening. The unstressed state of the band depicted in FIG. 5 corresponds to the pre-use access orientation of the scissors.

Figure 12:
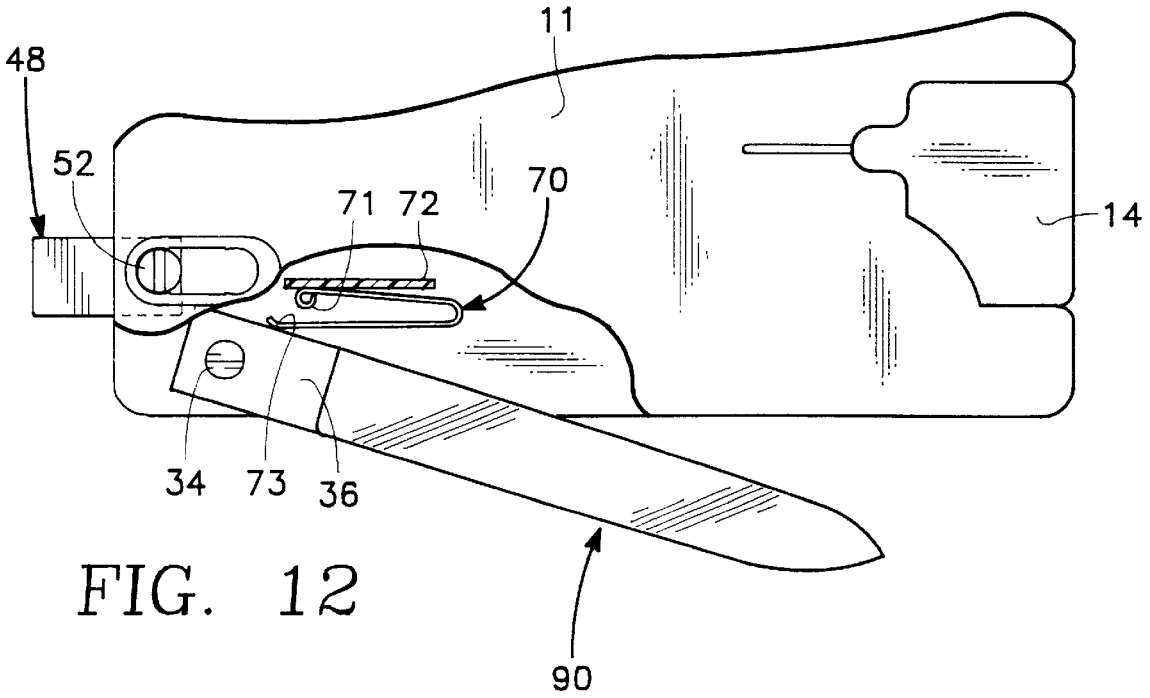
FIG. 12 is a view similar to FIG. 5 showing a knife blade in place of the scissors.

FIG. 12 depicts the above structures and actions with a knife blade in place of the scissors. As shown, blade 90 extends axially from pivot plate 36 in the same manner as attachment arm 28 of the scissors 18. The blade may be integral with the pivot plate and have a longitudinal extent no greater than the length of implement opening 20.

Figure 6:
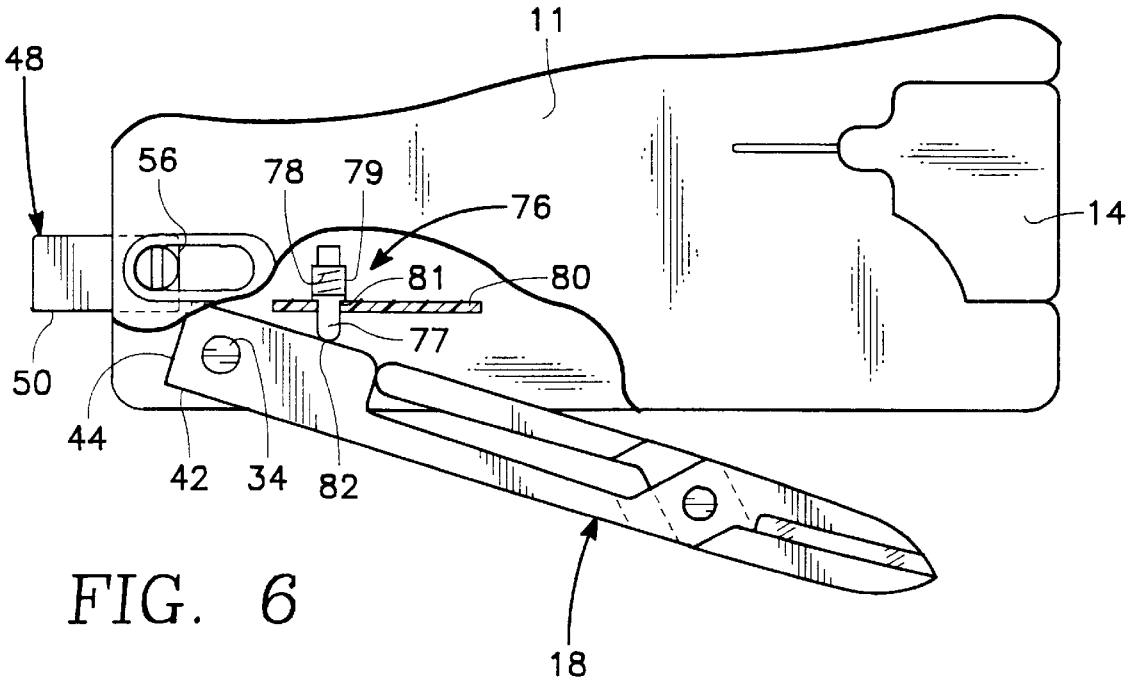
FIG. 6 is a view similar to FIG. 5 showing the scissors moved out of the housing with a spring actuated plunger.

FIG. 6 depicts an alternative biasing means comprising a spring biased plunger assembly 76. As illustrated, a plunger 77 is mounted for reciprocation against the bias of tension spring 78 in sleeve 79. The sleeve is secured to plunger wall 80 which extends upwardly from bottom sidewall 12. The plunger wall includes aperture 81 through which the plunger extends. The wall is longitudinally offset from implement post 34 and extends about parallel with abutment surface 50 a distance sufficient to engage actuating handle 27 when the scissors is in a stowed orientation.

As the scissors is rotated into implement opening 20, the plunger distal end 82 will ride against lock surface 40 of the pivot plate. This will cause the tension spring 78 to elongate and create an outward bias. When the scissors is released from its stowed orientation, the outward bias will push the plunger against the pivot plate and cause rotation of the scissors partially out of the implement opening to the aforementioned access orientation. It will be appreciated that the wall, sleeve and spring arrangement could be reversed from front to back. In this case, the spring being utilized would be a compression spring.

FIG. 7 illustrates a simplified alternative biasing means in which a torque resisting torsion spring is used. The overall scissors, lock plate, implement post and bumper part configuration is the same as that shown in FIGS. 1–4. However, in this embodiment, the flex strip is replaced with a coiled torsion spring 85. As shown, the spring coils are spiralled around implement post 34. The coil inner end 86 is secured to the implement post. The coil outer end 87 is fixed to pivot plate 36.

The torque of the torsion spring is predetermined so that the spring will be substantially unstressed when the scissors is partially out of the implement opening to the pre-use position. This position is illustrated in FIG. 7. When the scissors is rotated into the opening, the coils will tighten and a torsional tension will develop. When the scissors is released, this tension will cause a reverse rotation of the scissors out of the implement opening to a pre-use access orientation.

While the invention has been described with respect to preferred embodiments, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. A housing having an opening within which is pivotally attached an elongated implement;

said housing including an engagement means movable between a locked position and an unlocked position;

said implement having a terminal end comprising a pivot plate with predetermined outer end surfaces, each end surface having a different angular orientation relative to the implement longitudinal axis for angularly orienting said implement in selected positions when said engagement means is in said locked position, said engagement means comprising a lock plate which is movable axially in a direction about parallel with the longitudinal axis of said housing having an abutment surface releasably engageable with selected ones of said end surfaces; and, a biasing means for moving said elongated implement out of said opening to an access orientation when said engagement means is moved from said locked position to said unlocked position.

2. The housing of claim 1 wherein said biasing means is in a stressed state when said implement is in said opening.

3. The housing of claim 1 wherein said biasing means is selected from any one of the group consisting of spring actuated plunger, compression spring, tension spring, torsion spring and resilient band.

4. The housing of claim 1 wherein said implement is selected from at least one of the group consisting of a scissors and a knife blade.

5. The housing of claim 1 wherein said implement is a scissors and said housing includes an implement post in said opening adjacent said lock plate, said scissors including a pivot handle which is attached to said implement post.

6. The housing of claim 5 wherein said scissors includes an actuating handle that coacts with said pivot handle to effect operation of said scissors;

said actuating handle and pivot handle being adjacent each other when said scissors is in said opening; and, said biasing means comprising a spring member between said pivot handle and actuating handle that urges the handles apart when said scissors is in said opening.

7. A multi-purpose tool comprising:

a housing hating an implement opening;

an implement engageable with said opening;

an engagement means connected to said housing which is movable from a locked position for holding said implement in a stowed orientation in said opening to an unlocked position to permit movement out of said opening;

said implement comprising a scissors having an attachment arm and an actuating arm rotatably connected together by a swivel pin;

said attachment arm and actuating arm each having an outer free end portion extending outwardly from said swivel pin comprising a respective scissor blade;

said attachment arm and actuating are each having a respective inner end portion that extends inwardly from said swivel pin, the inner end portion of said actuating arm comprising an actuating handle and the inner end portion of said attachment arm comprising a pivot handle;

said pivot handle being rotatably connected to said housing by a connector means, said pivot handle including a pivot opening and said connector means comprising an implement post extending into said pivot opening, said pivot handle having a terminal end comprising a pivot plate with predetermined outer end surfaces with each end surface having a different angular orientation relative to the pivot handle longitudinal axis for angularly orienting said scissors in selected positions when the engagement means is in said locked position, said engagement means comprising a lock plate which is movable axially in a direction about parallel with the longitudinal axis of said housing having an abutment surface releasably engageable with selected ones of said end surfaces; and, a biasing means for moving said elongated implement out of said opening to an access orientation when said engagement means is moved from said locked position to said unlocked position.

8. The tool of claim 7 including a biasing means coacting with said housing and implement to move at least a portion of said scissors out of said opening to an access orientation.

9. The tool of claim 8 wherein said housing has opposing sidewalls with peripheral edges, said implement opening comprising spaced-apart portions of said housing sidewalls along a predetermined section of said housing peripheral edges.

10. The tool of claim 9 wherein at least one of said sidewalls defines a generally planar shape and said scissors moves in a plane about parallel to said planar shape.

11. The tool of claim 9 wherein said peripheral edges include an open corner and a closed corner, said implement opening extending between said open corner and closed corner.

12. The tool of claim 11 wherein said pivot plate is pivotally attached to said open corner.

13. The tool of claim 8 wherein said biasing means comprises a spring actuated plunger which is secured to said housing adjacent said scissors.

14. The tool of claim 8 including a flexible strip positioned between said pivot handle and actuating handle urging the handles apart when said scissors are in said stowed orientation.

15. The tool of claim 14 including a bumper part extending into said implement opening at a location inward and longitudinally offset from said implement post.

16. The tool of claim 8 wherein said biasing means is selected from any one of the group consisting of a spring actuated plunger, compression spring, tension spring, torsion spring, flexible strip and resilient band.

17. The tool of claim 7 wherein said biasing means comprises a torsion spring interconnecting said implement post and said pivot handle.

18. The tool of claim 7 wherein said housing has an open corner and said implement post is located at said open corner.

19. The tool of claim 7 wherein said housing has an open corner and a closed corner, said implement opening extending between said open corner and closed corner.

20. The tool of claim 19 wherein said scissors is pivotally attached to said housing at said open corner.

* * * * *